United States Patent [19]

Clark

[11] Patent Number: 4,516,309

[45] Date of Patent: May 14, 1985

[54] APPARATUS FOR ASSEMBLING AN ELECTRICAL CONNECTOR TO A CABLE

[75] Inventor: Donald G. Clark, Bideford, England

[73] Assignee: AMP Incorporated, Harrisburg, Pa.

[21] Appl. No.: 599,854

[22] Filed: Apr. 13, 1984

[51] Int. Cl.[3] ..... H01R 43/04

[52] U.S. Cl. ..... 29/564.4; 29/753

[58] Field of Search ..... 29/33 M, 564.4, 566.2, 29/753

[56] References Cited

U.S. PATENT DOCUMENTS 4,333,230 6/1982 Funcik et al. ..... 29/749

*Primary Examiner*—James M. Meister

*Attorney, Agent, or Firm*—Jay L. Seitchik

[57] ABSTRACT

Apparatus for assembling electrical connectors onto multiconductor electrical cable, the cable being a jacketed cable, comprises a table movable in opposite directions along two mutually perpendicular paths relative to a cable gripper mechanism, the table carrying a cable stripper mechanism and a press with a device for feeding a strip of connectors to the press. The table is arranged to move cyclically in such a way that, first, a cable held by the gripper mechanism has the jacket stripped from an end portion thereof by the stripper mechanism, whereafter the leading connector of the strip is held in the press and moved onto the end of the cable and is connected thereto by the press.

5 Claims, 9 Drawing Figures

APPARATUS FOR ASSEMBLING AN ELECTRICAL CONNECTOR TO A CABLE

This invention relates to apparatus for assembling an electrical connector to a multiconductor electrical cable.

In GB-A-2122819 there is described an electrical connector for terminating an end of a multiconductor electrical cable to provide means for connecting the conductors to other circuitry. The particular connector described is a plug connector for terminating a telephone apparatus cord and comprising a one-piece housing molded from electrically insulating plastic material with a cavity to receive an end of a multi-conductor insulated cord, and formed in a wall extending parallel to the direction of cord entry into the cavity with a plurality of slots each of which holds an electrical contact member having a first end directed into the cavity and adapted for penetrating the insulation and a conductor of a cord received in the cavity thereby to establish an electrical connection to the conductor, and a second end exposed to the exterior of the housing for mating with a contact member of an electrical socket connector with which the plug connector can be mated.

To assemble such a connector to a cord it is necessary for the outer jacket to be stripped from an end portion of the cord to expose end portions of the insulated conductors, the conductor end portions then being inserted into the cavity in the housing, and the contact members then being urged inwardly such that their first ends penetrate the insulation of respective conductors and thus establish electrical connections to the cores of the conductors.

As described in the above mentioned application the connectors can be provided in strip form, that is a plurality of the connectors can be carried by an integrally formed carrier strip, and this invention provides an apparatus for assembling such strip-form connectors onto multiconductor electrical cable.

According to this invention apparatus for assembling an electrical connector to a jacketed multiconductor electrical cable comprises, broadly stated, a table which is movable in opposite directions along each of two mutually perpendicular paths relative to a cable gripper mechanism, the table carrying a stripper mechanism and a press with an associated feed arrangement for feeding a strip of the connectos to the press, the table being arranged to effect a cycle of movements such that first a cable held by the gripper mechanism has the jacket stripped from an end portion thereof by the stripper mechanism, whereafter the leading connector of the strip is held in the press and moved obnto the end of the cable and connected thereto by the press.

It is an object of the invention to provide such apparatus which is automatic in operation, and which is also entirely reliable in use.

It is another object of the invention to provide such apparatus which is of simple construction and is thus economical to manufacture.

It is a further object of the invention to provide such apparatus which is capable of terminating jacketed telephone cord by means of connectors of the character described above.

Although U.S. Pat. No. 4,333,230 discloses apparatus for stripping wires and terminating them automatically to electrical connectors, the connectors are applied by the apparatus to unstripped ends to the wires and the apparatus does not comprise a table which is movable along two orthogonal paths.

EP-A-37202, to which U.S. patent application Ser. No. 135,740 filed on Mar. 31, 1980, now abandoned, corresponds, discloses wire stripping and terminating apparatus in which electrical connectors are moved along two orthogonal paths, for automatically terminating wires but neither the terminating nor the wire stripping means are moved along such paths, and the connectors are not applied to the stripped ends of the wires.

An apparatus according to an embodiment of this invention will now be described by way of example with reference to the accompanying partly diagrammatic drawings, from which other objects and advantages of the invention will appear and in which.

Figure 2:
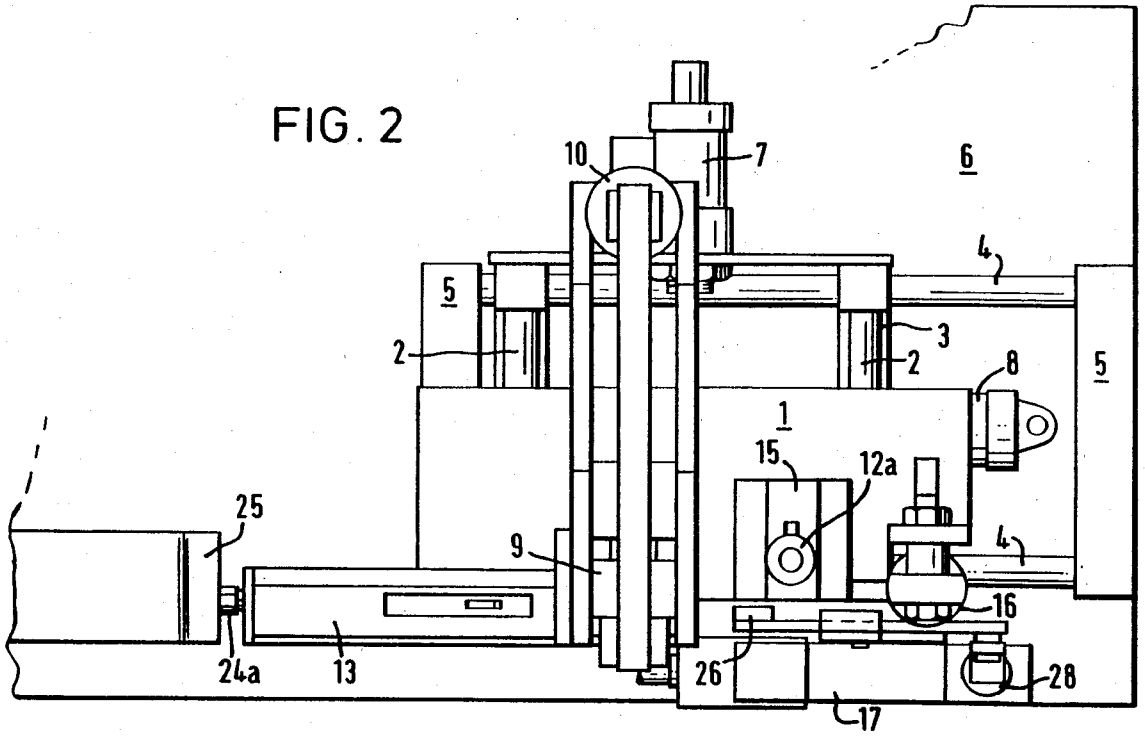
FIG. 2 is a plan view of the apparatus.

The apparatus comprises a table 1 mounted on a first pair of rails 2 for movement backwards and forwards along a first path (up and down as seen in FIG. 2) the first rails 2 being mounted on blocks 3 which are in turn mounted on a second pair of rails 4 for movement backwards and forwards along a second path (left and right as seen in FIG. 2) perpendicularly to the first path. The rails 4 are mounted on blocks 5 carried by a base plate 6 mounted on a work bench. Movement of the table 1 along the rails 2 is effected by means of a pneumatic piston and cylinder unit 7, while movement of the table along the rails 4 is effected by means of a pneumatic piston and cylinder unit 8.

The table 1 carries a crimping press 9 having an operating pneumatic piston and cylinder unit 10 which when actuated serves to urge a ram 11 of the press 9 towards an anvil 12 thereof. Adjacent to the anvil 12 is a connector feed track 13 along which, during use of the apparatus, a strip of electrical connectors according to GB-A-2122819 mentioned above, and which is incorporated by reference herein, is fed intermittently from a guide **13*a* by means of a feed finger 14, as described below. The anvil 12 is movable, for a purpose described below, slightly towards the ram 12 by means of a pneumatic piston and cylinder unit 12*a***, through a conventional linkage (not shown).

Also mounted on the table 1 is a cable stripper mechanism 15 operated by a pneumatic piston and cylinder unit 16, through a linkage **16*a* which mechanism 15** serves to strip the outer insulating jacket from an end portion of a jacketed multiinsulated-conductor cable in the form of a cord C of the kind described above.

Figure 3:
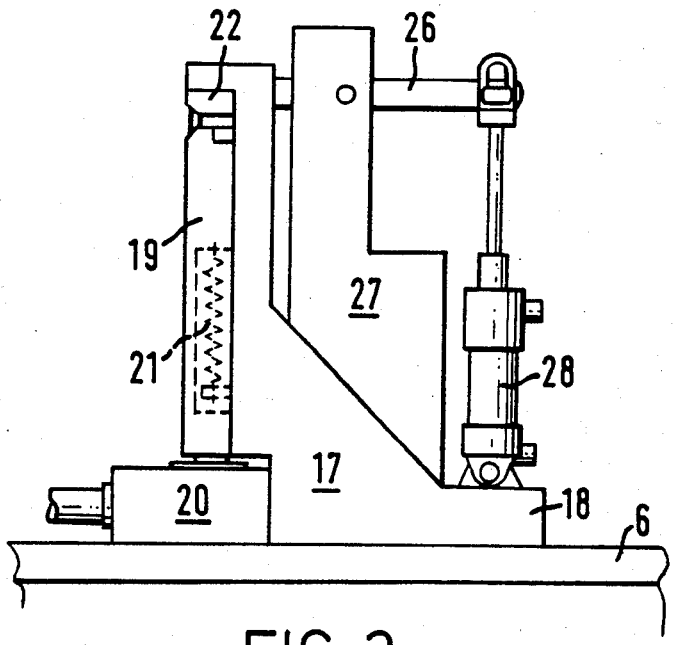
FIG. 3 is a side view showing a cable gripper mechanism and a conductor separator mechanism of the apparatus.

Also mounted on the base plate 6 is a cable gripper mechanism 17 comprising a mounting plate 18 having mounted thereon for sliding movement relative thereto a gripper bar 19 which can be urged by a pneumatic piston and cylinder unit 20, against the action of a spring 21 (FIG. 3), towards a projecting anvil portion 22 of the plate 18.

Mounted near the mechanism 17 is a conductor separator mechanism having a jaw 26, which is movable by means of a pneumatic piston and cylinder unit 28, and a fixed jaw 30.

Operation of the pneumatic piston and cylinder units is controlled by an electronic control module 31 which determines the sequence of operation, that is to say the cycling, of these units.

Figure 1:
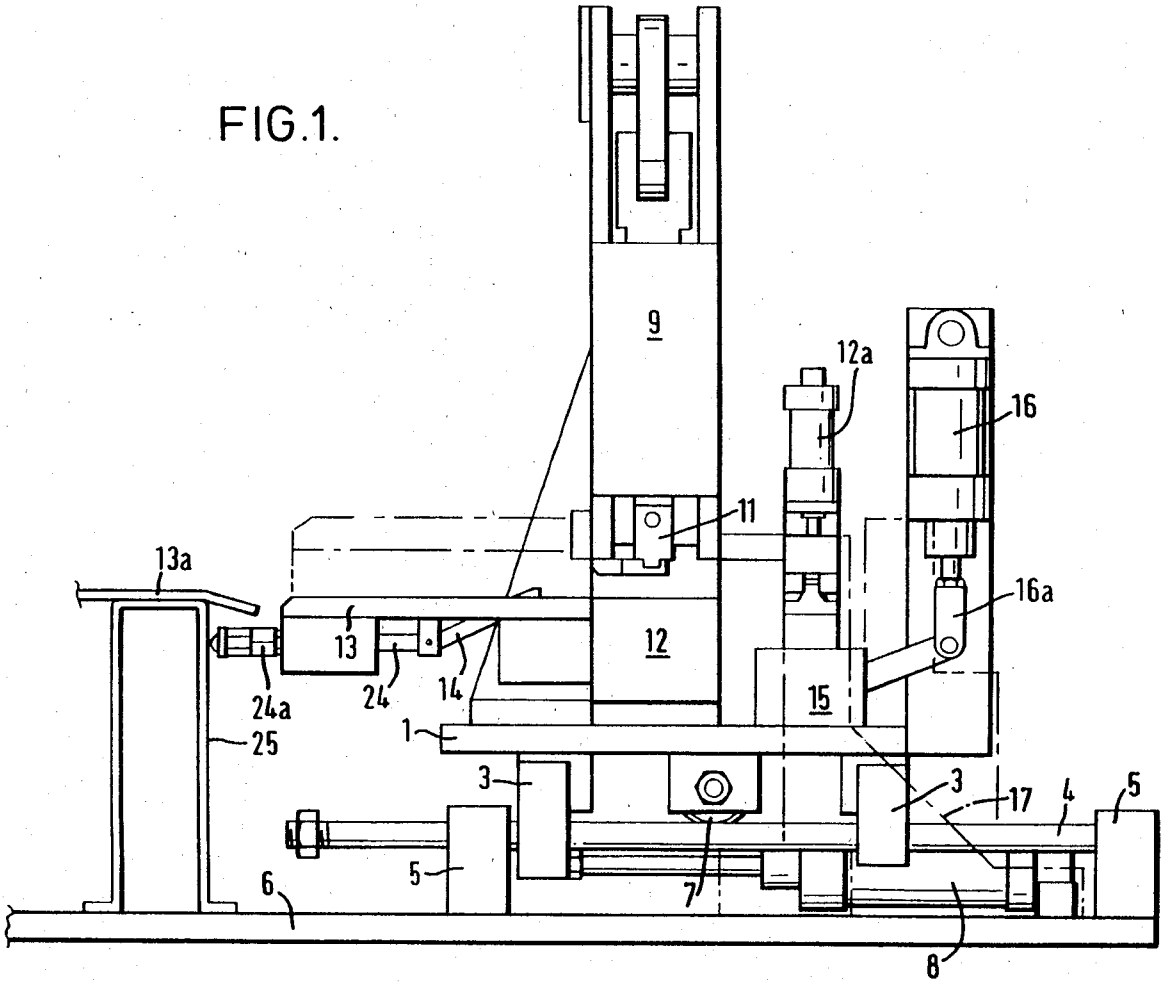
FIG. 1 is a front view of the apparatus with parts shown in broken lines.
Figure 4:
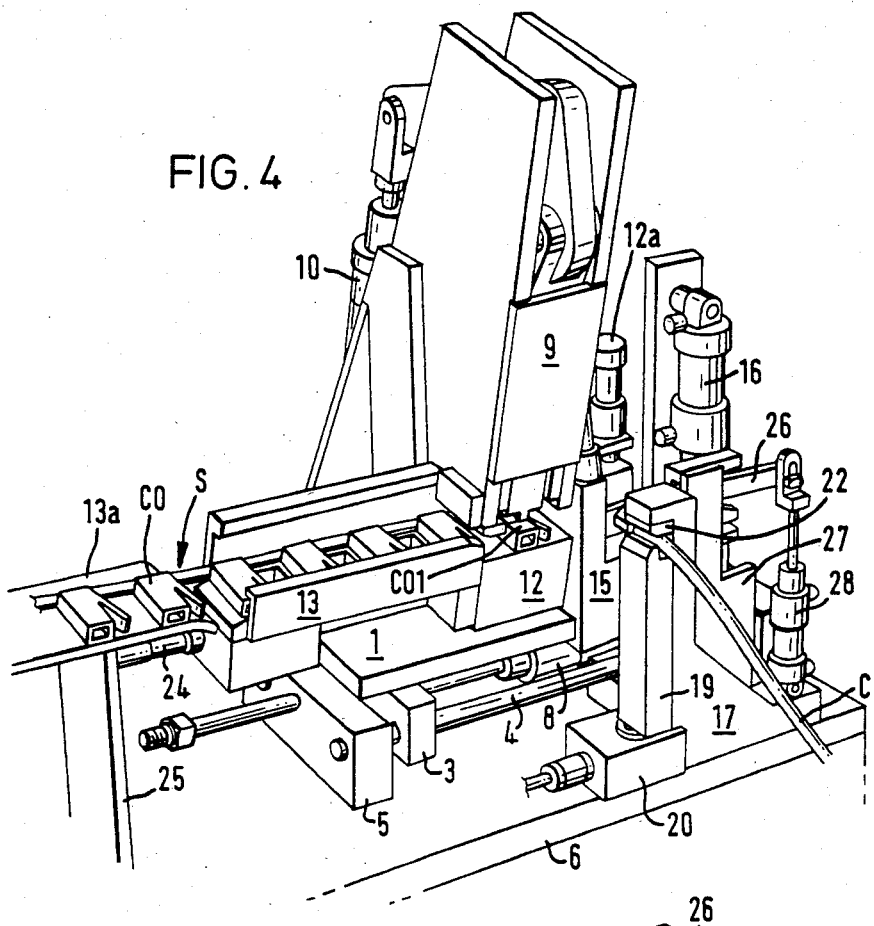
FIG. 4 is a front perspective view of the apparatus showing a cable gripped by the gripper mechanism.

The apparatus operates as follows:

Initially the table 1 is positioned with the cable stripper mechanism 15 aligned with the cable gripper mechanisms 17, as shown in FIGS. 1, 2 and 4. A strip S of connectors CO is located in the feed channel 13 with the leading connector CO1 of the strip located on the anvil 12 of the press 9.

The operator inserts an end of the cord C between the bar 19 and anvil 22 of the mechanism 17, between the jaws 26 and 30 which are open, and into the mechanism 15 the cable stripper blades (not shown) of which are open, and then presses a pedal switch (not shown) to activate the apparatus. The unit 20 urges the bar 19 towards the anvil 22 so that the cable is gripped therebetween. The unit 16 then operates causing the blades of the mechanism 15 to sever the jacket of the cord C at a position spaced from the end thereof. The unit 7 then operates to move the table 1 away from the mechanism 17 so that the mechanism 15, which is mounted on the table 1, removes the severed portion of the jacket from the end of the cord C. At the same time the unit 12*a* operates to raise the anvil 12 of the press 9 to an extent to cause the leading connector of the strip in the feed channel 13 to be gripped in the press 9 (FIG. 4).

Figure 5:
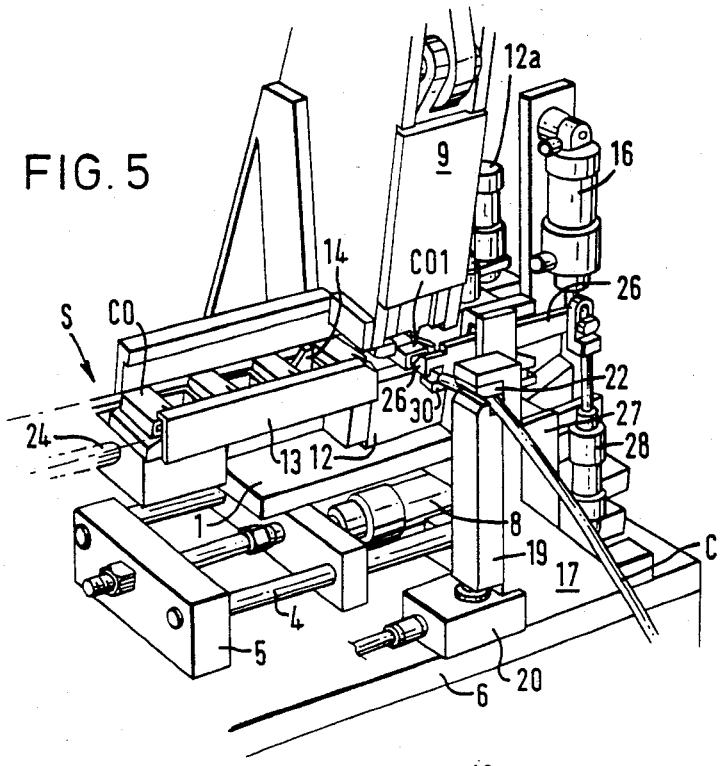
FIG. 5 is a similar view to that of FIG. 4, with parts omitted, but showing the stripped end of the cable about to be inserted into an electrical connector by means of the apparatus.
Figure 6:
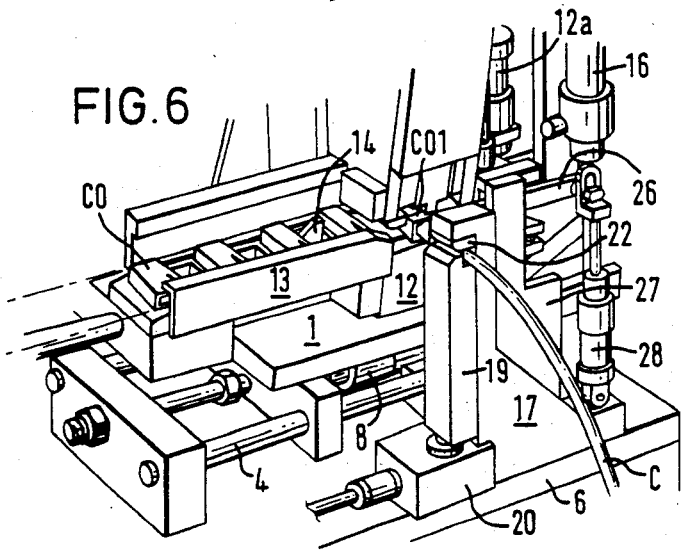
FIG. 6 is a similar view to that of FIG. 5, with further parts omitted, but showing the insertion of the cable end into the connector.
Figure 7:
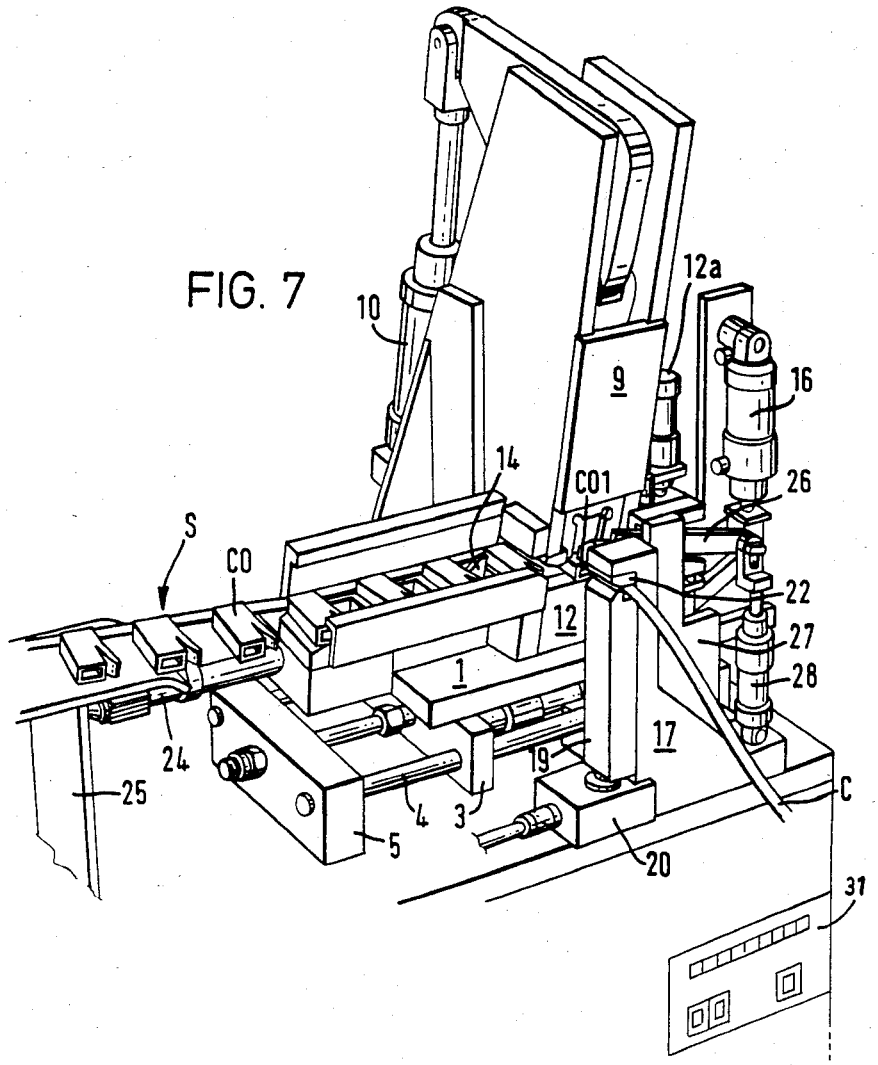
FIG. 7 is a front perspective view of the apparatus showing the connector whilst being crimped to the cable end by means of the apparatus.

The unit 8 now operates to translate the table 1 from its initial position to that of FIG. 5 to bring the leading connector CO1 held in the press 9 into register with the end of the cord C still held by the gripper mechanism 17. The unit 7 then operates to move the table 1 towards the mechanism 17 as shown in FIG. 6, whereby the end of the cord C is fully inserted into the connector CO1 held in the press 9. The press 9 is now operated by the unit 10 to urge the contacts of the connector CO1 into the housing thereof to effect the required connections to the respective insulated conductors of the cord C, and to sever the leading connector CO1 from the strip S in the feed channel 13 (FIG. 7).

Figure 8:
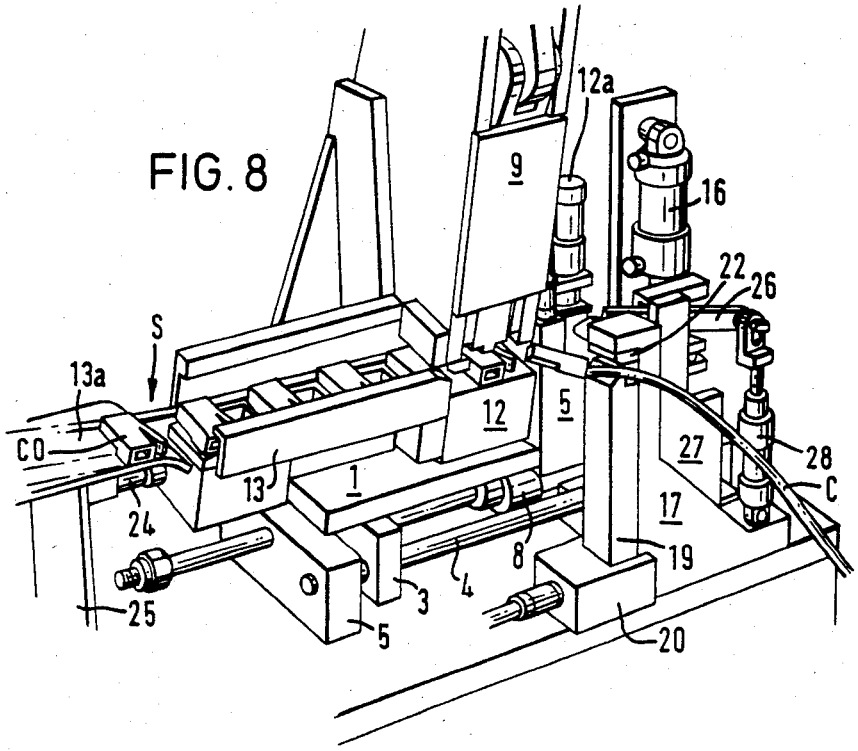
FIG. 8 is a similar view to that of FIG. 5, but showing the removal of the crimped connector and the cable from the apparatus.

The press 9 is then returned to its rest condition by the unit 10, and the units 20 and 12*a* and 28 are operated to release the cable and the connector CO1 connector thereto, the unit 28 raising the jaw 26 to this end. The terminated cord C can now be removed from the apparatus (FIG. 8) by the operator.

The unit 4 then operates to return the table 1 to its initial position so that the apparatus is ready for another cycle of operation. During this movement of the table 1 a head 24*a* of a drive rod 24 of the feed finger 14 engages a stop 25 mounted on the base plate 6 so that the feed finger 14 is operated to advance the new leading connector of the strip S in the feed channel 13 into position over the anvil 12 of the press 9.

Figure 9:
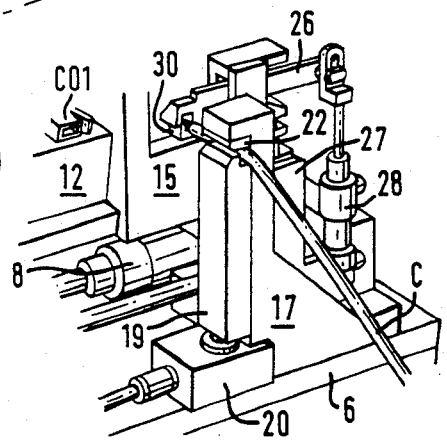
FIG. 9 is a perspective view showing a detail of the apparatus, operating to separate the conductors of the stripped cable end.

The conductor separator mechanism 27 is mounted for movement with the stripper mechanism 15 as it moves away from the gripper mechanism 17 to strip the end of the cord C. The jaw 28 is closed (FIG. 9) against the jaw 30 about the exposed conductors by the unit 28, combing means on these jaws serving to separate the conductors to the spacing of the contacts in the connector CO1 prior to their insertion into the connector CO1. The jaws 28 and 30 retain the conductors at this required spacing until the connector CO1 has been applied, whereafter the jaw 28 is raised by the unit 28 for the next cycle of operation of the apparatus.

I claim:

1. Apparatus for assembling an electrical connector to an end portion of a multiconductor electrical cable having a cable jacket, the apparatus comprising a table, a cable gripper mechanism beside the table, a cable jacket stripper mechanism on the table, a press on the table beside said stripper mechanism, for assembling a connector to the end portion of the cable, a connector feed mechanism on the press, for intermittently feeding a strip of electrical connectors thereto to position a leading connector of the strip in the press, means for releasably holding the leading connector in the press, means for translating the table in two opposite directions along first and second mutually perpendicular paths with respect to the cable gripper mechanism, drive means for said gripper, said stripper and said feed, mechanisms and said holding and said translating means, and control means for so cycling said drive means that the end portion of a cable held by the cable gripper mechanism is presented to the stripper mechanism whereby such mechanism strips the jacket from said end portion; said leading connector is held in the press by the connector holding means; said leading connector is moved onto said stripped end portion; and the press is actuated to assemble said leading connector to said stripped end portion.

2. Apparatus according to claim 1, in which said means for releasably holding said connector in the press comprises a drive unit connected to an anvil for supporting the leading connector, said unit being actuable to move the anvil towards a ram for assembling the leading connector to said stripped end portion.

3. Apparatus according to claim 1, further comprising a conductor separator mechanism including a fixed and a movable jaw, for separating the end portions of the conductors of the cable prior to the connector being moved onto the stripped end of the cable.

4. Apparatus according to claim 1, in which the cable gripper mechanism comprises a mounting plate having mounted thereon for sliding movement relative thereto, a gripper bar movable by a drive unit towards a projecting anvil portion of the mounting plate, against the action of a spring.

5. Apparatus according to claim 1, in which the table is mounted on a first pair of rails for reciprocating movement along said first path, said rails being mounted on blocks which are in turn mounted on a second pair of rails for moving said table along said second path.

* * * * *